US005598900A

United States Patent [19]

O'Rourke

[11] Patent Number: 5,598,900

[45] Date of Patent: Feb. 4, 1997

[54] HORIZONTAL LIFELINE ENERGY ABSORBER

[75] Inventor: Michael J. O'Rourke, Beaumont, Canada

[73] Assignee: Surety Manufacturing & Testing Ltd., Edmonton, Canada

[21] Appl. No.: 326,938

[22] Filed: Oct. 21, 1994

[51] Int. Cl.[6] ..... A62B 35/00

[52] U.S. Cl. ..... 182/3; 182/18

[58] Field of Search ..... 182/18, 3–7; 280/805; 188/371

[56] References Cited

U.S. PATENT DOCUMENTS

| | | | |
|---|---|---|---|
| 3,937,407 | 2/1976 | Matsuo | 280/805 X |
| 4,100,996 | 7/1978 | Sharp . | |
| 4,446,944 | 5/1984 | Forrest | 182/3 |
| 5,174,410 | 12/1992 | Casebolt | 182/3 |
| 5,287,943 | 2/1994 | Bell | 182/3 |

FOREIGN PATENT DOCUMENTS

| | | | |
|---|---|---|---|
| 2039004 | 3/1991 | Canada . | |
| 2103588 | 2/1992 | Canada . | |
| 2076695 | 8/1992 | Canada . | |
| 2109285 | 10/1993 | Canada . | |
| 2116886 | 3/1994 | Canada . | |
| 816821 | 4/1981 | U.S.S.R. | 182/3 |
| 962055 | 10/1982 | U.S.S.R. | 182/3 |
| 2191560 | 12/1987 | United Kingdom | 182/3 |

*Primary Examiner*—Alvin C. Chin-Shue

*Attorney, Agent, or Firm*—Sixbey, Friedman, Leedom & Ferguson, PC; Daniel W. Sixbey; Jeffrey L. Costellia

[57] ABSTRACT

An energy absorber for a horizontal lifeline protection system is provided. The energy absorber comprises a pair of independent shock absorbing units of similar construction. Each unit comprises a strip of woven webbing material and a strip of tear-ply webbing material. Each pair of corresponding ends of these strips are secured to each other and to a ring for securing to a portion of the horizontal lifeline fall protection system. The corresponding pairs of rings at each end are secured to each other. The woven webbing and tear-ply webbing of the units are folded and encased within a tearable envelope. The absorber is constructed so as to be secured to a horizontal lifeline within a fall protection system so that when a predetermined force is applied to the rings, the envelope tears and the tear-ply webbing separates, resulting in an overall elongation of the absorber. In the event the tear-ply webbing separates completely, the remaining force is applied to the woven webbing.

8 Claims, 2 Drawing Sheets

HORIZONTAL LIFELINE ENERGY ABSORBER

FIELD OF THE INVENTION

The present invention relates to an energy absorber designed to be included in an integral part of a horizontal lifeline fall protection system. The prime function of the absorber is to reduce the forces acting on end anchors holding the horizontal lifeline taut.

BACKGROUND OF THE INVENTION

A horizontal lifeline is typically a steel cable or synthetic rope which is tensioned between two anchor points at either end of an exposed work area. The worker attaches to the lifeline with a lanyard/harness and moves freely between the end anchors. A fall is arrested by the harness, lanyard, horizontal lifeline and ultimately the anchors. Although the forces generated by a fall of this type are easily survivable by the worker, the forces transmitted to the end anchors through the tensioned lifeline can be tremendous. It is thus important, in the event of a fall, to ensure that the end anchors and line itself have not been damaged, and to minimize any subsequent chance for a failure of the system in the event of a further fall.

Synthetic devices which absorb energy, for use in worker protection, are not unique. Personal shock absorbers are conventional, and may be connected directly to a harness worn by a worker. Such shock absorbers are designed to limit the forces experienced by the worker in the event of a fall. Although use of a personal shock absorber will lower the arrest force transmitted to the end anchors of a horizontal lifeline, it is an object of the present invention to provide an improved design of horizontal lifeline system which includes an energy absorber to complement the use of a personal shock absorber by a worker.

Typically energy absorbers have been designed to be permanently installed and withstand harsh environmental conditions. This requires the use of metallic components that are cumbersome and expensive.

References of background interest describing and illustrating personal shock absorbers for workers include U.S. Pat. No. 4,100,996 of Sharp issued Jul. 18, 1978, laid-open Canadian Patent Application Ser. No. 2,109,285 of Wolner et al published May 1, 1994, laid-open Canadian Patent Application Ser. No. 2,103,588 of Crawford published Aug. 7, 1992, and laid-open Canadian Patent Application Ser. No. 2,076,695 of Casebolt published Feb. 25, 1994.

Mechanical shock absorber systems for lifelines are described and illustrated in laid-open Canadian Patent Application Ser. No. 2,116,886 of Duncan published Sep. 10, 1994 and laid-open Canadian Patent Application Ser. No. 2,039,004 of Sulowski et al published Jul. 23, 1992.

OBJECTS OF THE INVENTION

It is an object of the present invention to provide an energy absorber for horizontal lifeline fall protection systems which minimizes the use of metallic components.

It is a further object of the present invention to provide such an energy absorber which will, in the event of a fall, provide a visible warning that the system has sustained the force of a fall.

SUMMARY OF THE INVENTION

In accordance with the present invention an energy absorber for a horizontal lifeline protection system is provided. The energy absorber comprises a pair of independent shock absorbing units of similar construction. Each unit comprises a strip of woven webbing material and a strip of tear-ply webbing material. Each pair of corresponding ends of these strips are secured to each other and to a ring for securing to a portion of the horizontal lifeline fall protection system. The corresponding pairs of rings at each end are secured to each other. The woven webbing and tear-ply webbing of the units are folded and encased within a tearable envelope. The absorber is constructed so as to be secured to a horizontal lifeline within a fall protection system so that when a predetermined force is applied to the rings, the envelope tears and the tear-ply webbing separates, resulting in an overall elongation of the absorber. In the event the tear-ply webbing separates completely, the remaining force is applied to the woven webbing.

In a preferred embodiment of the present invention the rings are Dee rings and the woven webbing strip is of nylon (trade-mark) as is the strip of tear-ply webbing.

The energy absorber according to the present invention will dissipate forces experienced by the end anchors of the horizontal lifeline, thereby reducing damage to the anchor support and/or minimizing the chances of failure of the fall arrest system. Further, in the event of a fall, the energy absorber according to the present invention deploys by elongation, and thereby provides a visible warning that the system has sustained the force of a fall. By using such an energy absorber in the system, it is possible to increase allowable lifeline spans and/or provide protection for an additional worker on a single span.

BRIEF DESCRIPTION OF THE DRAWINGS

These and other advantages of the invention will become apparent upon reading the following detailed description and upon referring to the drawings in which.

Figure 1:
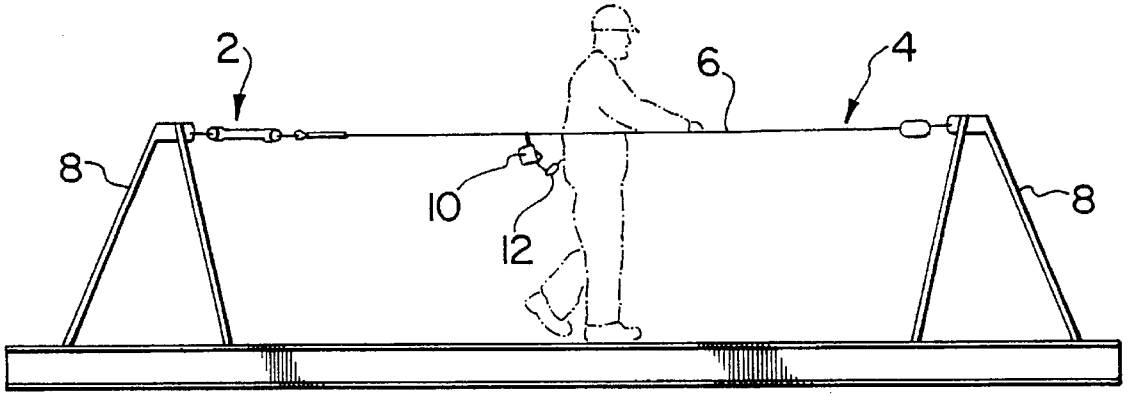
FIG. 1 is a side view of a horizontal lifeline fall protection system incorporating an energy absorber in accordance with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 3:
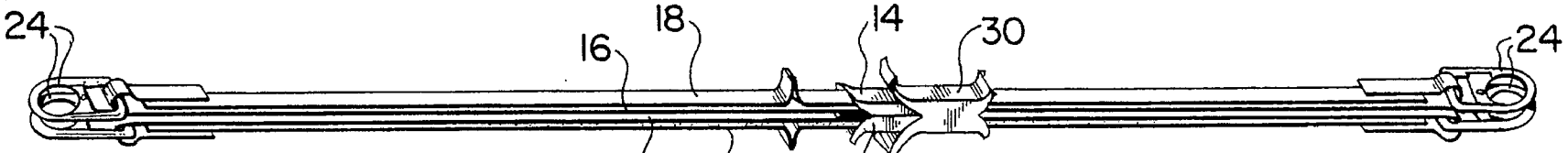
FIG. 3 is a further perspective view of the energy absorber of FIG. 2, in deployed (elongated) position.
Figures 2, 4:
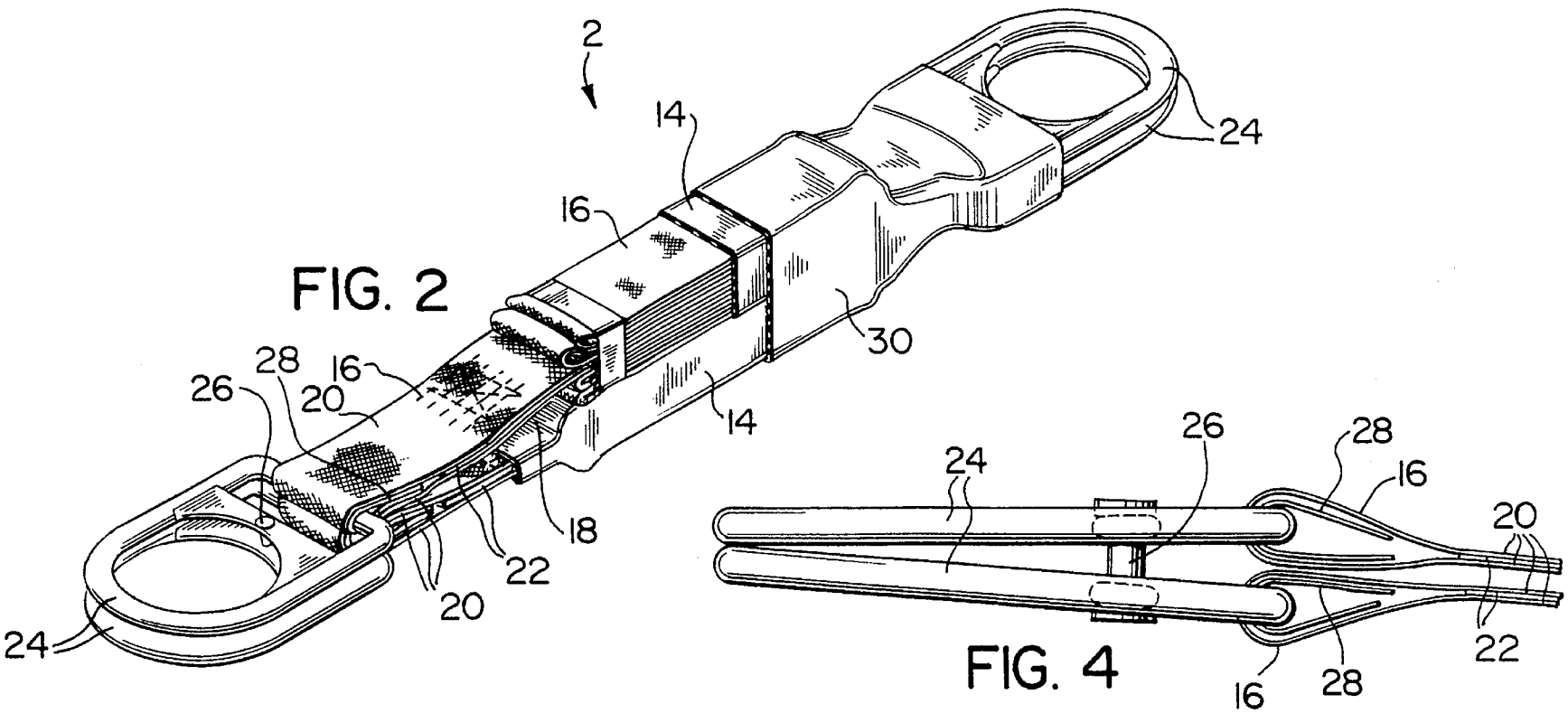
FIG. 2 is a perspective view of an energy absorber in accordance with the present invention, in initial, unextended configuration, with part of its casing broken away.
FIG. 4 is a partial view, from the top, of one end of the energy absorber of FIG. 2 partially broken away.

Turning to FIG. 1, there is illustrated an energy absorber 2 incorporated in a fall protection system 4, the fall protection system including a cable 6, tautly suspended between two anchors 8 as illustrated. A worker's lanyard 10, secured to a harness 12 worn by the worker, is slidably secured to line 6. As can be seen in more detail in FIGS. 2, 3 and 4, energy absorber 2 comprises a similar pair of independent shock absorbing units 14. Each unit comprises a strip of woven, synthetic webbing 16 (e.g. nylon) and a strip of synthetic tear-ply webbing material 18 (again preferably nylon). In each unit, each pair of corresponding ends 20 and 22 of strips 16 and 18 respectively are secured to each other by stitching and to a Dee ring 24. As can be seen in FIG. 4, the corresponding pairs of Dee rings 24 at each end are secured to each other by way of a rivet 26. As well, a wear pad 28, again preferably of woven nylon fabric, circumscribes a portion of each ring 24, underneath ends 20 and 22 of strips 16 and 18. Strips 16 and 18 of each unit are folded and the folded strips of the two units are encased within a tearable rubber envelope 30. The lengths of strips 16 and 18 are such, and the absorbing is constructed so that, when a predetermined force is applied to the rings 24, envelope 30 tears and the tear-ply webbing 18 separates. This results in an overall elongation of the absorber 2 (FIG. 3) and, in the event that the tear-ply webbing separates completely, the remaining force is then applied to the synthetic webbing 16, as that webbing becomes fully deployed in elongated fashion. It will be understood that the energy absorber 2 according to the present invention is made of entirely synthetic, common non-metallic components, except for the connecting Dee rings 24, enabling the device to readily withstand harsh environmental conditions and avoiding the use of metallic components that are cumbersome and expensive. Nevertheless energy absorber 2 dissipates energy in a fashion similar to that of a permanent metallic energy absorber device. The simple construction and mainly synthetic components of the device according to the present invention make a lightweight and very low cost product. The incorporation of a pair of similar shock absorbing units, in a parallel configuration, greatly enhances the safety of the energy absorber according to the present invention.

When force is applied to the Dee rings, and the tear-ply webbing separates, resulting in an overall elongation of the device, the fact that the device has sustained a fall is readily visibly apparent from the tearing of the envelope 30 and the elongation of the tear-ply webbing 18.

Thus, it is apparent that there has been provided in accordance with the invention a horizontal lifeline energy absorber that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An energy absorber for a horizontal lifeline protection system, the energy absorber comprising a pair of independent shock absorbing units of similar construction including corresponding ends, each unit comprising a strip of woven webbing material and a strip of tear-ply webbing material, wherein the corresponding ends of the strip of woven webbing material and the strip of tear-ply webbing material of each unit are secured to each other and to a ring for securing to a portion of the horizontal lifeline fall protection system, the ring at each corresponding end of the units being secured to each other and the pair of units being folded and encased within a single tearable envelope, the absorber constructed to be secured to a horizontal lifeline within a fall protection system so that when a predetermined force is applied to the rings, the envelope tears and the tear-ply webbing separates, resulting in an overall elongation of the absorber, and, in the event the tear-ply webbing separates completely, the remaining force is applied to the woven webbing.

2. An absorber according to claim 1 wherein the ring at each corresponding end of the units is a Dee ring.

3. An absorber according to claim 2 wherein Dee rings at each corresponding end of the units are secured together by rivets.

4. An absorber according to claim 1 wherein the woven webbing material comprises synthetic material.

5. An absorber according to claim 4 wherein the synthetic material comprises nylon.

6. An absorber according to claim 1 wherein the envelope is rubber.

7. An absorber according to claim 1 releasably secured to a horizontal lifeline suspended between a pair on anchorage points.

8. The energy absorber of claim 1 wherein each independent shock absorbing unit is individually encased within a tearable sleeve.

* * * * *